US008292633B2

(12) United States Patent
Ju

(10) Patent No.: US 8,292,633 B2
(45) Date of Patent: Oct. 23, 2012

(54) ELECTRICAL CONNECTOR FOR AVOIDING TERMINALS FROM GOING BEYOND PADS OF MATING DEVICE

(75) Inventor: Ted Ju, Keelung (TW)

(73) Assignee: Lotes Co., Ltd, Keelung (TW)

( * ) Notice: Subject to any disclaimer, the term of this patent is extended or adjusted under 35 U.S.C. 154(b) by 495 days.

(21) Appl. No.: 12/565,052

(22) Filed: Sep. 23, 2009

(65) Prior Publication Data

US 2011/0003489 A1 Jan. 6, 2011

(30) Foreign Application Priority Data

Jul. 3, 2009 (CN) ..... 2009 2 0059776 U

(51) Int. Cl.
*H01R 12/00* (2006.01)

(52) U.S. Cl. ..... 439/71; 439/74

(58) Field of Classification Search ..... None
See application file for complete search history.

(56) References Cited

U.S. PATENT DOCUMENTS

| | | | | |
|---|---|---|---|---|
| 4,390,220 | A * | 6/1983 | Benasutti | 439/71 |
| 5,407,360 | A * | 4/1995 | Belopolsky | 439/71 |
| 6,947,291 | B2 * | 9/2005 | Chua et al. | 361/760 |
| 6,948,946 | B1 * | 9/2005 | Ju | 439/71 |
| 7,014,477 | B2 * | 3/2006 | Tsai | 439/71 |
| 7,104,827 | B1 * | 9/2006 | Huang | 439/331 |
| 7,578,678 | B2 * | 8/2009 | Xie et al. | 439/71 |
| 2004/0209492 | A1 * | 10/2004 | Kajinuma et al. | 439/71 |

* cited by examiner

*Primary Examiner* — Michael Zarroli
(74) *Attorney, Agent, or Firm* — Ming Chow; Sinorica, LLC

(57) ABSTRACT

The present invention provides an electrical connector for electrically connecting a mating device having pads, comprising: a body with a stopping portion and a plurality of terminals with contact parts contacting the pads. The terminals have a first and a second movement path. During the first path, contact part and mating device move toward stopping portion simultaneously. During the second path, contact part moves toward stopping portion relative to mating device, and the horizontal displacement of terminals is smaller than width of the pads. Compared with prior art, it is guaranteed the relative displacement between terminal and pad is reduced under the condition of fixed horizontal displacement of terminal. As the relative displacement still exists, terminal and pad can scrape the grime on surface while allowing movement of contact part within the area of the pads.

17 Claims, 6 Drawing Sheets

ELECTRICAL CONNECTOR FOR AVOIDING TERMINALS FROM GOING BEYOND PADS OF MATING DEVICE

FIELD OF THE INVENTION

The present invention relates to an electrical connector, and particularly to an electrical connector for electrically connecting a mating device to a circuit board.

BACKGROUND OF THE INVENTION

A land grid array (LGA) electrical connector according to the prior art is used to electrically connect a chip to a circuit board, and is applied extensively to high-frequency and high-speed transmission devices, and has superior electrical conduction properties. However, with the increasing of the chip's transmission rate, the number of pads set on the chip increases accordingly. Under a certain constraint on the chip's volume, it is unavoidable to reduce the area or the width of a single pad. Consequently, the LGA electrical connector according to the prior art cannot satisfy the requirements imposed by the development of the chip any longer.

FIG. 1 shows a cross-sectional view and a partially enlarged view of an LGA electrical connector (a) according to the prior art while connecting to a chip. The LGA electrical connector (a) is electrically connected to a chip (b) having a plurality of pads (b1) and comprises a base (a1) and a plurality of terminals (a2) obliquely disposed in the base (a1). The base (a1) includes a first sidewall (a11), a second sidewall (a12) facing to the first sidewall (a11), and a receiving space (a13). While being used, the chip (b) is disposed in the receiving space (a13), and the pads (b1) contact the terminals (a2) correspondingly. In order to align precisely, the gaps between the chip (b) and the first sidewall (a11) and between the chip (b) and the second sidewall (a12) are small. While the chip (b) being pressed downward, the pads (b1) press the terminals (a2). The terminals (a2) move with respect to the pads while being pressed and thus scrape against the pads for removing grime thereon.

Although the electrical connector described above has the benefit of removing grime by scraping between the terminals and the pads, it still has a drawback. Under a certain downward press on the chip, the horizontal displacement of the terminals with respect to the pads is fixed. Given the fixed horizontal displacement, if the area or width of the pads shrinks, the terminals will definitely go beyond the pads and cannot be controlled within the area of the pads. Consequently, the electrical connector cannot connect to the chip normally.

Accordingly, it is necessary to design a novel electrical connector for solving the problem described above.

SUMMARY

An objective of the present invention is to provide an electrical connector, which can not only remove surface grime by scraping between the terminals thereof and the pads of a mating device, but also avoid the terminals from going beyond the area of the pads.

In order to achieve the objective described above, an electrical connector for electrically connecting to a mating device having a plurality of pads according to an embodiment of the present invention comprises a body and a plurality of terminals. The body has a stopping portion for limiting the horizontal displacement of the mating device. The terminal includes an elastic part and a contact part located on one end of the elastic part for connecting to the mating device. The elastic part tilts toward the stopping portion, and the contact part contacts the pad. Besides, the terminal has a first movement path and a second movement path. In the first movement path, the contact part and the mating device move toward the stopping portion simultaneously until the mating device touches the stopping portion. In the second movement path, the contact part moves relatively to the mating device toward the stopping portion. During this process, the horizontal displacement of the terminal is smaller than the width of the pad.

An electrical connector for electrically connecting to a mating device having a plurality of pads according to another embodiment of the present invention comprises a body and a plurality of terminals. The body has a stopping portion for limiting the horizontal displacement of the mating device. The terminal includes an elastic part and a contact part located on one end of the elastic part for connecting to the mating device. The elastic part tilts toward the stopping portion, and the contact part contacts the pad. Define a first gap between the mating device and the stopping portion in the horizontal direction as X when the mating device is set on the terminals, the horizontal displacement of the contact part as X1 when the first gap X becomes zero, the maximum downward displacement of the mating device as Y, and the width of the pads as Z. Then Y, X, and X1 must satisfy the relation $Y \geqq f(X)+g(X1)$, and Z and X1 must satisfy the relation $Z \geqq X1$, where f (X) is the vertical upward displacement of the contact part when its horizontal displacement is X, and g (X1) is the vertical downward displacement of the contact part when its horizontal displacement is X1.

In comparison to the prior art, when the chip is pressed by a certain displacement downward on the electrical connector according to the present invention, in the first movement path, there is no relative displacement between the terminal and the mating device; in the second movement path, the terminal moves relatively to the mating device, and the horizontal displacement of the terminal is smaller than width of the pad, guaranteeing the relative displacement between the terminal and the pad is reduced under the condition of fixed horizontal displacement of the terminals. In addition, because the relative displacement still exists, the terminal and the pad can scrape each other's surface grime while allowing movement of the contact part within the area of the pad.

DETAILED DESCRIPTION

Figure 1:
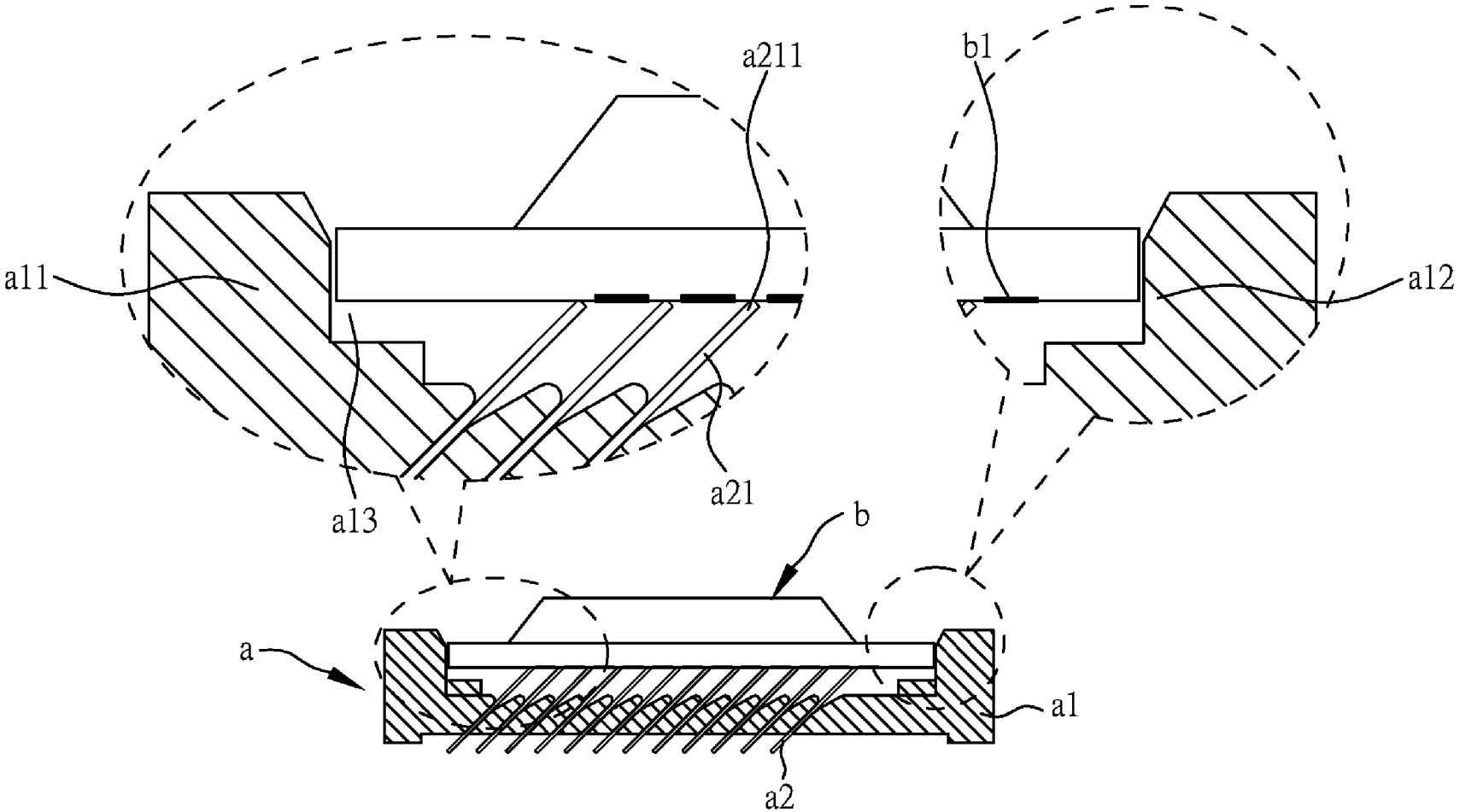
FIG 1 (Prior Art)
FIG. 1 shows a cross-sectional view and a partially enlarged view of an LGA electrical connector according to the prior art while connecting to a chip.
Figure 2:
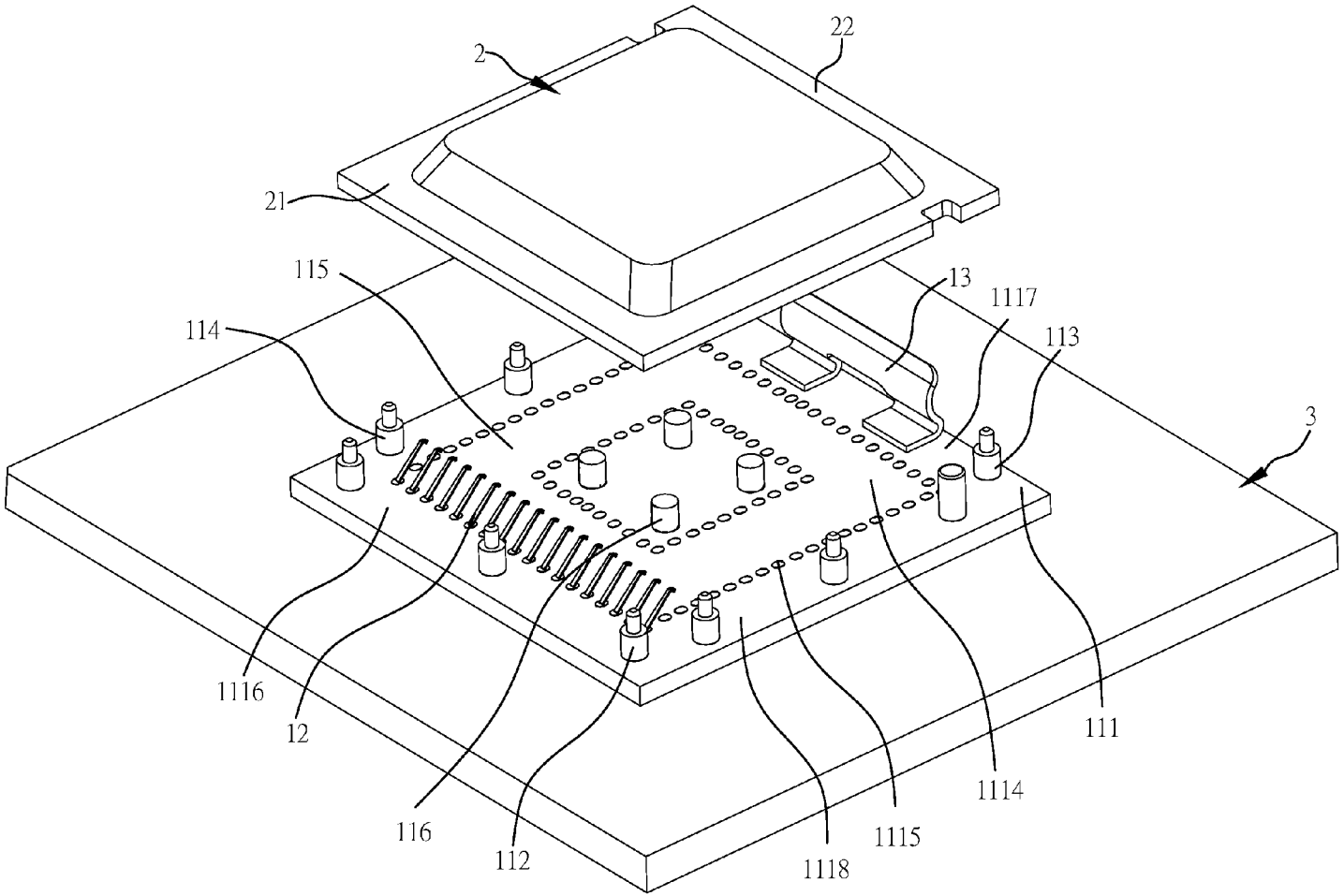
FIG. 2 shows an isometric view of an electrical connector according to an embodiment of the present invention while connecting to a chip and a circuit board.

Reference will now be made to the drawings to describe the present invention in detail.

FIGS. 2 to 5 show the first embodiment of the present invention. The electrical connector 1 according to the present invention is used for electrically connecting a mating device to a circuit board 3. According to the present embodiment, the mating device is a chip 2. It can, of course, be a circuit board or other devices. The chip 2 is roughly a square with a first side 21 and a second side 22 facing to the first side 21. At the bottom surface of the chip 2, a plurality of circular or square (or other shapes) pads 23 are arranged at intervals.

The electrical connector 1 comprises a body 11, a plurality of terminals 12 and an elastic piece 13 disposed on the body 11. The body is not formed integrally but separately by several parts for the purpose of choosing various materials conveniently, and includes a substrate 111 and a positioning mechanism located around the substrate 111. The positioning mechanism includes three first positioning pillars 112, two second positioning pillars 113, and four third positioning pillars 114. The first, second, and third positioning pillars 112, 113, 114 surround to form a receiving space 115. Besides, four support pieces 116 are set at the center of the substrate 111 for supporting the chip 2.

The substrate 111 can be made of the same materials as the printed circuit boards according to the prior art (such as FR-4 substrate). While soldering the substrate 111 to the circuit board 3, because the material of the substrate 111 is the same as that of the circuit board 3, bending and deformation caused by difference in expansion coefficients can be avoided. The substrate 111 appears roughly a square with a top surface 1111, a bottom surface 1112, and a plurality of fixing holes 1113. At the periphery of the center of the substrate 111, a conductive region 1114 is formed by two concentric squares. The left and right sides adjacent to the conductive region 1114 on the substrate 111 are a first edge 1116 and a second edge 1117 of the substrate 111; the front and rear sides adjacent to the conductive region 1114 on the substrate 111 are two third edges 1118 of the substrate 111. On the top surface 1111 and the bottom surface 1112, a plurality of soldering pads 1115 are arranged evenly in the conductive region 1114. On the bottom surface 1112, a plurality of tin balls 1119 are soldered to the circuit board 3 corresponding to the soldering pads 1115 for achieving electrical conduction between the electrical connector 1 and the circuit board 3.

The first positioning pillars 112 are located on the first edge 1116 and are cross-shaped. (Of course, it can be other shapes.) At the center, there is a first blocking part 1121. A stopper 1122 is extending upward from the first blocking part 1121. A first fixing part 1123 is extending downward from the first blocking part 1121. The width of the first blocking part 1121 is greater than that of the stopper 1122. Besides, the first blocking part 1121 touches the top surface 1111 of the first edge 1116 tightly. The first fixing part 1123 is located in the fixing hole 1113.

The second positioning pillars 113 and the third positioning pillars 114 are located on the second edge 1117 and the two third edges 1118, respectively. The second positioning pillars 113 and the first positioning pillars 112 are set oppositely with identical structures. The second positioning pillars 113 have a second blocking part 1131 and a stopping portion 1132 and a second fixing part 1133 located on both ends of the second blocking part 1131, respectively. In addition, the second blocking part 1131 touches the top surface 1111 of the second edge 1117 tightly. The second fixing part 1133 is located in the fixing hole 1113.

The terminals 12 are set in the conductive region 1114 and tilt toward the stopping portion 1132. Each of the terminals 12 has an elastic part 121, a contact part 122 and a conduction part 123 extending from both ends of the elastic part 121, respectively. The elastic part 121 is linear and set at an angle. (Of course, it can be other shapes.) The contact part 122 extends into the receiving space 115 for electrically connecting with the chip 2. The conduction part 123 is soldered on the soldering pad 1115 for electrically connecting with the circuit board 3. The elastic part 121 is positioned to form an angle with the substrate 111. When the terminals 12 are set onto the substrate 111 initially, the angle is defined as $\theta$. The length of the elastic part 121 is defined as L. Then the vertical distance between the contact part 122 and the conduction part 123 is $L \sin\theta$, while the horizontal distance thereof is $L \cos\theta$.

Figure 3:
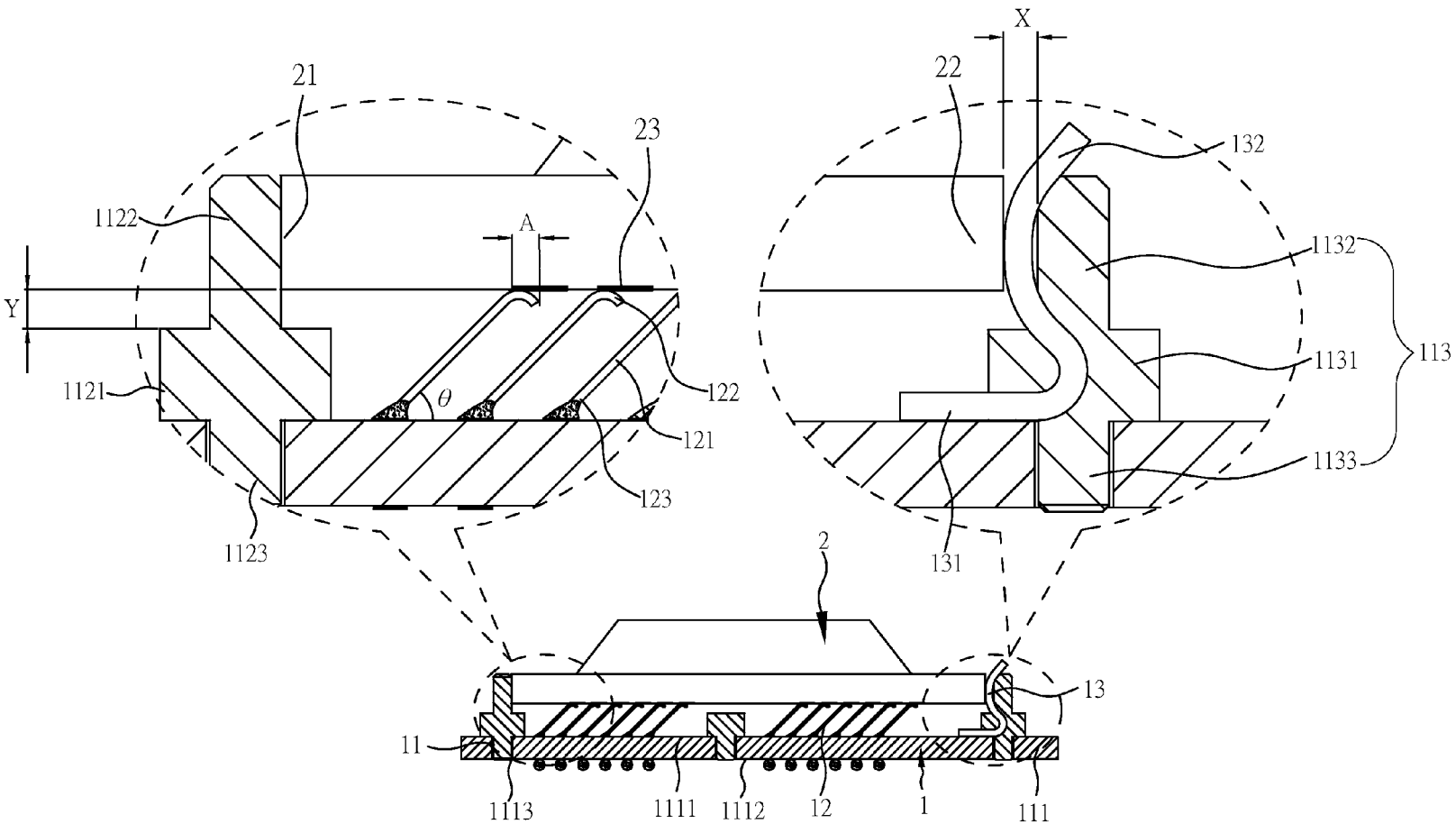
FIG. 3 shows a cross-sectional view and a partially enlarged view before the chip and the terminals are pressed according to an embodiment of the present invention.
Figure 4:
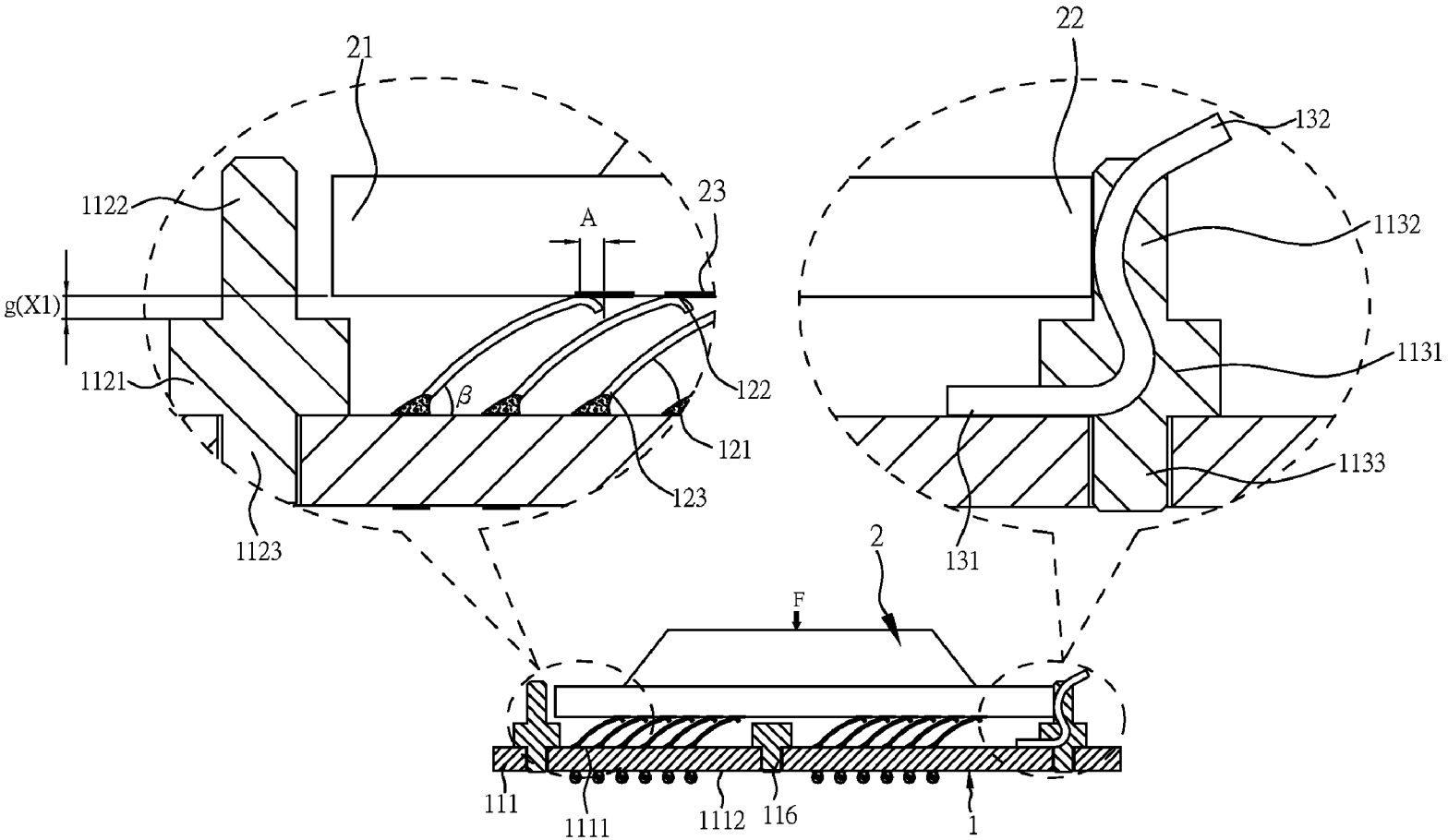
FIG. 4 shows a cross-sectional view and a partially enlarged view when the first movement path during the pressing process of the chip and the terminals is finished according to an embodiment of the present invention.
Figure 5:
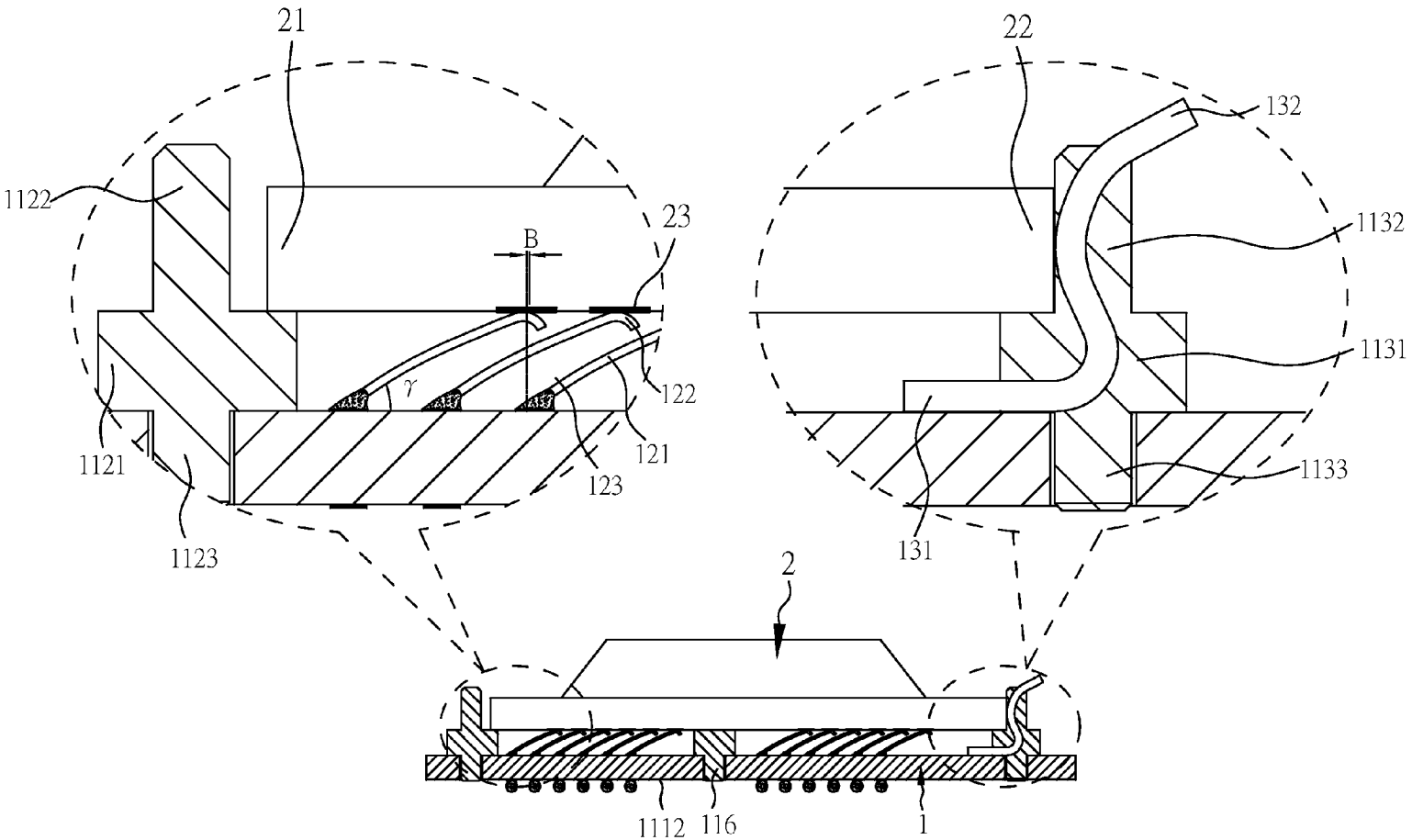
FIG. 5 shows a cross-sectional view and a partially enlarged view after the chip and the terminals are pressed according to an embodiment of the present invention.

The elastic piece 13 is located on the second edge 1117, including a longitudinal base part 131 soldered or fixed on the top surface 1111, and an elastic arm 132 extending upward and curvedly. The elastic arm 132 is adjacent to the stopping portion 1132 for touching and holding the chip 2. As shown in FIGS. 3 to 5, while being used, the chip 2 is firstly put in the receiving space 115. When the chip 2 contacts the terminals 12, the left ends of the pads 23 contact the contact parts 122 correspondingly. A first distance is defined as A between the contact part 122 and the center line of the pad 23. The first side 21 contacts the stopper 1122 correspondingly; and the second side 22 contacts the elastic piece 13 correspondingly. The elastic piece 13 applies a fixing force on the chip 2 toward the first positioning pillar 112, so that the first side 21 can touch the stopping portion 1132 tightly and hence it is beneficial to mate between the pads 23 and the contact parts 122. There is a first gap X between the second side 22 and the stopping portion 1132 in the horizontal direction, so that the chip 2 can move in the horizontal direction. When the chip 2 moves horizontally by X, the vertical movement of the contact part 122 is defined as f(X). The chip 2 has a maximum downward displacement. According to the present embodiment, the maximum displacement is defined as Y. According to the present embodiment, when the chip 2 is put on the terminals 12, the distance in the vertical direction between the first blocking part 1121 and the second blocking part 1131 is just the maximum displacement. While not being pressed, the maximum displacement Y has at least two segments. One segment is f(X) described above. Define the other segment as g(X1), where X1 is the horizontal displacement of the contact part 122 when the vertical displacement of the chip 2 is g(X1). Define the width of the pad 23 as Z. Then X1 and Z should satisfy the relation $X1 \leqq Z$ for making the contact part 122 move relatively within the area of each pad 23. In order to make the contact part 122 be able to move by f(X) vertically and to further move by g(X1) in the vertical direction, the maximum displacement should satisfy $Y \geqq f(X)+g(X1)$.

Next, exert a force F to the chip 2 to make the chip 2 move downward. In this process, the terminals 12 will also move downward and make a moving step. According to the present embodiment, the moving step includes a first movement path and a second movement path.

The first movement path includes pressing the chip 2 downward to touch the contact part 122, so that the maximum displacement is decreasing gradually. By pressing and touching by the chip 2, the terminals 12 will have certain elastic deformation in the vertical direction. Because the terminals 12 are set on the substrate 111 at an angle, the elastic part 121 will also deform toward the second positioning pillars 113, so the angle decreases gradually. Owing to friction between the pad 23 and the contact part 122, the elastic part 121 will drive the chip 2 to move toward the direction it deforms at the same time, so that the pad 23 makes no relative displacement with respect to the contact part 122. That is, the first distance remains constant, while the first gap decreases gradually. The elastic piece 13 deforms elastically toward the second positioning pillars 113 due to pressure from the second side 22 until the second side 22 touches the stopping portion 1132, namely, until the first gap is reduced to zero. At this moment, the chip 2 will not be able to move toward the second positioning pillars 113, and the first movement path of the terminals 12 ends.

When the first movement path ends, the angle at this time is defined as $\beta$. Assume that the nonlinear deformation of the terminals 12 is approximately linear, the length L is constant. Hence, the vertical distance between the contact part 122 and the conduction part 123 is $L \sin \beta$, while the horizontal distance therebetween is $L \cos \beta$. When the terminal 12 is not pressed, the vertical distance between the contact part 122 and the conduction part 123 is $L \sin \theta$ and the horizontal distance therebetween is $L \cos \theta$, thus it is deduced that, during the first movement path, the horizontal displacement of the contact part 122 is $(\cos \beta - \cos \theta)L$, while the vertical displacement is $f(X)=(\sin \theta - \sin \beta) L$. In addition, when the first movement path ends, the horizontal displacement of the contact part 122 is just the first gap X, therefore $X=(\cos \beta - \cos \theta)L$. Accordingly, $f(X)=(\sin \theta - \sin \beta)/(\cos \beta - \cos \theta)X$.

Continue exerting the force F, the chip 2 can move downward continuously until it reaches the vertical displacement g(X1), which, according to the present embodiment, happens when the chip 2 just touches the first blocking part 1121 and the second blocking part 1131. That is, the g(X1) is exactly the value of subtracting f(X) from Y. Of course, according to another embodiment, g(X1) can be smaller than the value of subtracting f(X) from Y. At this moment, the support piece 116 is close to or just touches the chip 2 for supporting the chip 2, so that when the chip 2 experiences greater pressure, it will not easily deform. During this process, the chip 2 cannot move toward the second pillars 113 but the elastic part 121 can do so as the chip 2 is pressed downward. Besides, the horizontal displacement of the contact part 122 along the pad 23 is X1. The first distance changes from A to zero, and then from zero to B. Define the angle at this moment as $\gamma$. Assume that the nonlinear deformation of the terminals 12 is approximately linear and the length L is constant. Hence, the vertical distance between the contact part 122 and the conduction part 123 is $L \sin \gamma$, while the horizontal distance therebetween is $L \cos \gamma$. When the terminal 12 is not pressed, the vertical distance between the contact part 122 and the conduction part 123 is $L \sin \theta$ and the horizontal distance therebetween is $L \cos \theta$, thus it is deduced that, during the first movement path, the horizontal displacement of the contact part 122 is $(\cos \gamma - \cos \beta)L$, while the vertical displacement is $g(X1)=(\sin \beta - \sin \gamma)L$. Thus, $g(X1)=(\sin \beta - \sin \gamma)/(\cos \gamma - \cos \beta)X1$. In addition, because the maximum displacement $Y>f(X)+g(X1)$, $Y>(\sin \theta - \sin \beta)/(\cos \beta - \cos \theta)X+(\sin \beta - \sin \gamma)/(\cos \gamma - \cos \beta)$.

When the chip 2 is pressed by a certain displacement downward on the electrical connector 1, in the first movement path, there is no relative displacement between the terminal 12 and the chip 2; in the second movement path, the terminal 12 moves relatively to the chip 2, and the horizontal displacement of the terminal 12 is smaller than the width of the pad 23, guaranteeing the relative displacement between the terminal 12 and the pad 23 is reduced under the condition of fixed horizontal displacement of the terminal 12 in comparison to the prior art. In addition, because the relative displacement still exists, the terminal 12 and the pad 23 can scrape each other's surface grime while allowing movement of the contact part 122 within the area of the pad 23.

Figure 6:
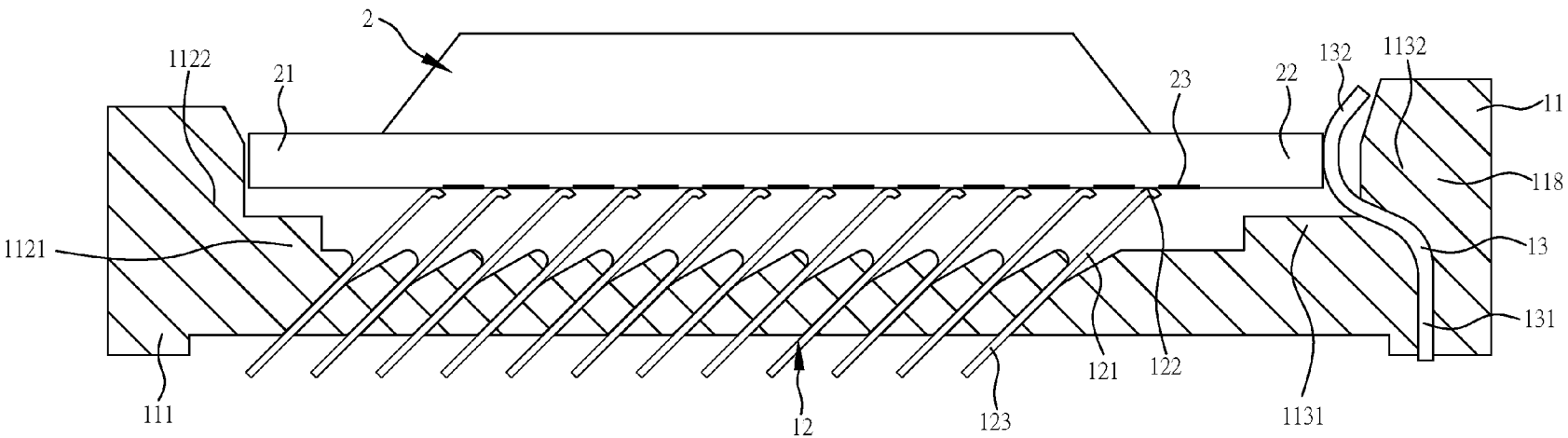
FIG. 6 shows a schematic diagram of an electrical connector according to the second embodiment of the present invention.

FIG. 6 shows a schematic diagram of an electrical connector 1 according to a second embodiment of the present invention. It differs from the first embodiment in that:

1. The body 11 is formed integrally, and comprises a substrate 111 and two opposite positioning protrusions 118 extending upward. The positioning protrusions 118 act as the positioning mechanism. The first blocking part 1121, the stopper 1122, the second blocking part 1131, and the stopping portion 1132 are all set on the positioning protrusions 118. Of course, the stopper 1122 and the stopping portion 1132 can be set on different positioning protrusions 118.
2. The substrate 111 has neither pads 1115 nor tin balls 1119. The pads 123 protrude from one side of the substrate 111, and contact a circuit board (not shown in the figure) by compression or soldering.
3. The elastic piece 13 is plugged in the substrate 111, and is soldered directly onto the circuit board 3.

According to the present embodiment, because the body 11 is formed integrally, it has the advantage of simple structure, which is beneficial for manufacturing and saving cost.

According to another embodiment, the substrate 111 can be omitted. Instead, a printed circuit board can be adopted with a plurality of terminals 12 soldered thereon as well as with several positioning pillars. This way, the structure is even simpler and more materials can be saved. Moreover, the elastic piece 13 can be omitted as long as the existence of the first gap between the mating device and the positioning pillars in the direction the terminals 12 tilt can be guaranteed. If the terminals 12 are not linear, the benefits of removing surface grime by scraping between the terminals 12 and the pads 23 as well as correct positioning can be achieved once the relation $Y>f(X)+g(X1)$ is satisfied.

To sum up, the electrical connector according to the present invention has the following advantages:

1. In the first movement path, the terminals and the chip do not move relatively. In the second movement path, the terminals move relatively to the chip. Besides, the horizontal displacement of the terminals is smaller than width of the pads. In comparison to the prior art, the displacement of the terminals relative to the pads is reduced. Furthermore, because relative movement still exists, the benefits of removing surface grime by scraping between the terminals and the pads can be achieved while allowing movement of the contact parts within the area of the pads.
2. The contact parts are located on the edge of the pads opposite to the direction of the horizontal movement of the terminals, namely, the left edge, and hence it is beneficial for the contact parts to move horizontally along the pads with greater displacement. Thereby, after the terminals undergo the first movement path and the second movement path, escaping of the contact parts beyond the pads can be prevented.
3. The elastic piece will exert fixing force on the chip toward the direction of the first positioning pillars, which is beneficial to position the pads and the contact parts correctly.
4. When the chip is pressed by the force F and touches the support piece, the support piece will support the chip. Thereby, under greater pressure, the chip is not easy to deform.
5. The body can be manufactured by assembling as well as integrally. Thereby, the structure is simpler, which in turn is advantageous for manufacturing and saving cost.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. An electrical connector, electrically connecting a mating device which has a plurality of pads, comprising:

a body, having a stopping portion for limiting the horizontal displacement of the mating device; and a plurality of terminals, including an elastic part and a contact part, the contact part locating on one end of the elastic part for connecting the mating device, the elastic part tilting toward the direction of the stopping portion, and the contact part contacting the pad;

wherein the terminals have a first movement path and a second movement path; in the first movement path, the contact part and the mating device move toward the direction of the stopping portion simultaneously until the mating device touches the stopping portion; in the second movement path, the contact part moves relative to the mating device toward the direction of the stopping portion; and during this process, the horizontal displacement of the terminals is smaller than width of the pads; and the body further has a blocking part for limiting vertical movement of the mating device so that when the second movement path ends, the mating device touches the blocking part.

2. The electrical connector of claim 1, characterized in that the body further has a positioning mechanism, the blocking part and the stopping portion are located on the positioning mechanism.

3. The electrical connector of claim 1, characterized in that when the mating device is disposed on the terminals, the contact parts are located on one edge of the pads opposite to the horizontal direction the terminals move.

4. The electrical connector of claim 1, characterized in that the body includes a substrate for fixing the terminals and a positioning protrusion extending upward from the substrate, and that the stopping portion is located on the positioning protrusion.

5. The electrical connector of claim 1, characterized in that the body includes a substrate for fixing the terminals and a positioning pillar extending upward from the substrate, and that the stopping portion is located on the positioning pillar.

6. The electrical connector of claim 1, characterized in that at least one support piece is defined at the center of the body for supporting the mating device.

7. The electrical connector of claim 1, characterized in that a plurality of tin balls are defined on the bottom surface of the body corresponding to the terminals for soldering to a circuit board.

8. The electrical connector of claim 1, characterized by further comprising:

an elastic piece, adjacent to the stopping portion; and a stopper, defined on the body, facing to the elastic piece;

wherein when the mating device is put on the terminals, the elastic piece pushes the mating device so that the mating device touches the stopper and forms a first gap between the mating device and the stopping portion in the horizontal direction.

9. An electrical connector, electrically connecting to a mating device which has a plurality of pads, comprising:

a body, having a stopping portion for limiting the horizontal displacement of the mating device; and a plurality of terminals, including an elastic part and a contact part for connecting to the mating device, the contact part locating on one end of the elastic part, the elastic part tilting toward the direction of the stopping portion, and the contact part contacting the pad;

wherein defining the first gap between the mating device and the stopping portion in the horizontal direction as X when the mating device is initially set on the terminals, the maximum downward displacement of the mating device as Y, the horizontal displacement of the contact part as X1 when the first gap X becomes zero, and the width of the pads as Z, then Y, X, and X1 must satisfy the relation $Y \geqq f(X)+g(X1)$, and Z and X1 must satisfy the relation $Z \geqq X1$, wherein f (X) is the vertical upward displacement of the contact part when its horizontal displacement is X, and g (X1) is the vertical downward displacement of the contact part when its horizontal displacement is X1; and the body further has a blocking part for limiting vertical movement of the mating device so that when the mating device is put on the terminals, the distance between the terminals and the blocking part is the maximum displacement.

10. The electrical connector of claim 9, characterized in that the elastic part is linear and set at an angle, and $f(X)=(\sin\theta-\sin\beta)/(\cos\beta-\cos\theta)X$ and $g(X1)=(\sin\beta-\sin\gamma)/(\cos\gamma-\cos\beta)X1$, where $\theta$ is the tilt angle before the terminals are pressed; $\beta$ is the tilt angle when the first gap becomes zero; and $\gamma$ is the tilt angle of the terminals when the contact part moves horizontally by X1.

11. The electrical connector of claim 10, characterized in that the body further has a positioning mechanism, and the blocking part and the stopping portion are located on the positioning mechanism.

12. The electrical connector of claim 9, characterized in that when the mating device is put on the terminals, the contact parts are located on one edge of the pads opposite to the horizontal direction the terminals move.

13. The electrical connector of claim 9, characterized in that the body includes a substrate for fixing the terminals and a positioning protrusion extending upward from the substrate, and that the stopping portion is located on the positioning protrusion.

14. The electrical connector of claim 9, characterized in that the body includes a substrate for fixing the terminals and a positioning pillar extending upward from the substrate, and that the stopping portion is located on the positioning pillar.

15. The electrical connector of claim 9, characterized in that at least one support piece is set at the center of the body for supporting the mating device.

16. The electrical connector of claim 9, characterized in that a plurality of tin balls is set on the bottom surface of the body corresponding to the terminals for soldering to a circuit board.

17. The electrical connector of claim 9, characterized by further comprising:

an elastic piece, adjacent to the stopping portion; and a stopper, disposed on the body, facing to the elastic piece;

wherein when the mating device is put on the terminals, the elastic piece pushes the mating device so that the mating device touches the stopper and forms a first gap between the mating device and the stopping portion in the horizontal direction.

* * * * *